US006712681B1

(12) United States Patent
Chen et al.

(10) Patent No.: US 6,712,681 B1
(45) Date of Patent: Mar. 30, 2004

(54) POLISHING PADS WITH POLYMER FILLED FIBROUS WEB, AND METHODS FOR FABRICATING AND USING SAME

(75) Inventors: Shyng-Tsong Chen, Patterson, NY (US); Kenneth P. Rodbell, Sandy Hook, CT (US); Oscar Kai Chi Hsu, Chelmsford, MA (US); Jean Vangsness, Stow, MA (US); David S. Gilbride, Lowell, MA (US); Scott Clayton Billings, Kingston, NH (US); Kenneth Davis, Newburgh, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/715,184

(22) Filed: Nov. 20, 2000

Related U.S. Application Data

(63) Continuation-in-part of application No. 09/599,514, filed on Jun. 23, 2000.
(60) Provisional application No. 60/214,774, filed on Jun. 29, 2000.

(51) Int. Cl.[7] ..... B24D 11/00
(52) U.S. Cl. ..... 451/532; 451/536
(58) Field of Search ..... 451/526, 527, 451/528, 529, 530, 531, 532, 536, 41

(56) References Cited

U.S. PATENT DOCUMENTS

| | | | | | |
|---|---|---|---|---|---|
| 4,927,432 | A | * | 5/1990 | Budinger et al. | 51/298 |
| 4,944,836 | A | | 7/1990 | Beyer et al. | |
| 5,197,999 | A | * | 3/1993 | Thomas | 51/298 |
| 2002/0077034 | A1 | * | 6/2002 | Tolles | 451/41 |

OTHER PUBLICATIONS

U.S. patent application Ser. No. 09/599,514, Chen et al., filed Jun. 23, 2000.
U.S. patent application Ser. No. 09/605,869, Chen et al., filed Jun. 29, 2000.
U.S. patent application Ser. No. 09/668,142, Chen et al., filed Sep. 25, 2000.

* cited by examiner

*Primary Examiner*—Dung Van Nguyen
(74) *Attorney, Agent, or Firm*—Connolly Bove Lodge & Hutz LLP; Robert M. Trepp, Esq.

(57) ABSTRACT

A polishing pad having a body comprising fibers embedded in a matrix polymer formed by a reaction of polymer precursors. The fibers define interstices, and the precursors fill these interstices substantially completely before completion of the reaction. The pad may include a thin layer of free fibers at its polishing surface. A segment of at least a portion of the free fibers are embedded in the adjacent body of the polymer and fibers. The fibers may be separate, or in the form of a woven or non-woven web.

24 Claims, 3 Drawing Sheets

POLISHING PADS WITH POLYMER FILLED FIBROUS WEB, AND METHODS FOR FABRICATING AND USING SAME

RELATED APPLICATION

This application is a Continuation-in-part of U.S. patent application Ser. No. 09/599,514, filed Jun. 23, 2000, for a "Multilayered Polishing Pad, Method for Fabricating, and Uses Thereof", and claims the benefit under 35 U.S.C. §119(e) of Provisional Application Serial No. 60/214,774, filed Jun. 29, 2000, and entitled "Grooved Polishing Pads and Methods of Use", the entire contents of these applications being incorporated herein by reference.

FIELD OF THE INVENTION

The present invention relates to polishing pads. The polishing pads of the present invention are especially useful in chemical-mechanical planarization of semiconductor wafers. Specifically the invention relates to pads of increased stiffness to prevent over polishing, and increased hardness and thickness for greater useful life. The present invention is also applicable to the polishing of other surfaces, for example optical glass and CRT and flat panel display screens. The present invention further relates to methods for fabricating and using the pads.

BACKGROUND OF INVENTION

For many years, optical lenses and semiconductor wafers have been polished by chemical-mechanical means. More recently, this technique has been applied as a means of planarizing intermetal dielectric layers of silicon dioxide and for removing portions of conductive layers within integrated circuit devices as they are fabricated on various substrates. For example, a conformal layer of silicon dioxide may cover a metal interconnect such that the upper surface of the layer is characterized by a series of non-planar steps corresponding in height and width to the underlying metal interconnects.

The rapid advances in semiconductor technology has seen the advent of very large scale integration (VLSI) and ultra large scale integration (ULSI) circuits resulting in the packing of very many more devices in smaller areas on a semiconductor substrate. The greater device densities require greater degrees of planarity to permit the higher resolution lithographic processes required to form the greater number of devices having smaller features as incorporated in current designs. Moreover, copper, because of its low resistance, is increasingly being used as interconnects. Conventionally, etching techniques are used to planarize conductive (metal) and insulator surfaces. However, certain metals, desirable for their advantageous properties when used as interconnects (Au, Ag, Cu) are not readily amenable to etching, thus the need for chemical-mechanical polishing (CMP).

Typically, the various metal interconnects are formed through lithographic or damascene processes. The damascene technique is described in U.S. Pat. No. 4,789,648, to Chow, et al. assigned to the assignee of the present invention, the entire contents of which are incorporated herein by reference. For example, in a lithographic process, a first blanket metal layer is deposited on a first insulating layer, following which electrical lines are formed by subtractive etching through a first mask. A second insulating layer is placed over the first metallized layer, and holes are patterned into the second insulating layer using a second mask. Metal columns or plugs are formed by filling the holes with metal. A second blanket metal layer is formed over the second insulating layer, the plugs electrically connecting the first and second metal layers. The second metal layer is masked and etched to form a second set of electrical lines. This process is repeated as required to generate the desired device.

Presently, VLSI uses aluminum for the wiring and tungsten for the plugs because of their susceptibility to etching. However, the resistivity of copper is superior to either aluminum or tungsten, making its use desirable, but copper does not have desirable properties with respect to etching.

Variations in the heights of the upper surface of the intermetal dielectric layer have several undesirable characteristics. The optical resolution of subsequent photolithographic processing steps may be degraded by non-planar dielectric surfaces. Loss of optical resolution lowers the resolution at which lines may be printed. Moreover, where the step height is large, the coverage of a second metal layer over the dielectric layer may be incomplete, leading to open circuits.

In view of these problems, methods have been evolved to planarize the upper surfaces of the metal and dielectric layers. One such technique is chemical-mechanical polishing (CMP) using an abrasive polishing agent worked by a rotating polishing pad. A chemical-mechanical polishing method is described in U.S. Pat. No. 4,944,836, Beyer, et al., assigned to the assignee of the present invention, the entire contents of which are incorporated herein by reference. Conventional polishing pads are made of a relatively soft and flexible material, such as nonwoven fibers interconnected together by a relatively small amount of a polyurethane adhesive binder, or may be laminated layers with variations of physical properties throughout the thickness of the pad. Multilayer pads generally have a flexible top polishing layer backed by a layer of stiffer material.

The CMP art combines the chemical conversion of a surface layer to be removed, with the mechanical removal of the conversion product. Ideally, the conversion product is soft, facilitating high polishing rates. CMP pads must resolve two constraints relevant to the present invention. The surface in contact with the substrate to be polished must be resilient. Of particular relevance to the present invention is the problem of local over polishing, also known as "dishing", resulting from too flexible a pad. This is one of the key problems encountered during CMP of metal substrates. Also, an increased number and density of defects in the polished surface may be caused by frayed and loose fibers that develop as conventional fibrous pads become worn. Such defects correlate with low yields of product.

Some of the most commonly used polishing pads for manufacturing semiconductor chips are a very soft foam pad, or a soft nonwoven fiber pad. An advantage of a soft polishing pad is low defect density on the polished wafer and good within-wafer uniformity. However, soft CMP pads suffer from very short pad life requiring replacement after polishing about 50 wafers, and excessive dishing of the polished wafer because of the pad softness. Also, for a metal damascene CMP process, a soft pad usually causes much more dishing compared with a hard pad.

It is generally known that prevention of dishing requires a stiffer pad. Thus, a hard polishing pad usually has better planarization capability than a soft pad. However, the defects count is much higher than with the soft pad and the within-wafer uniformity is usually much worse. In addition, hard pads may be conditionable, which means that the pad surface condition can be regenerated using a diamond disk or an abrasive roller to recondition the pad surface by removing worn areas and embedded debris. This reconditioning capability means that a hard pad may last much longer than a soft pad. Such reconditioning in situ also means that polishing tool down time for pad replacement is greatly reduced.

Currently, these problems are handled using multi-step techniques wherein initial polishing is effected at a high rate using one set of pads and abrasive compounds, followed by a second polishing step using a second set of pads and abrasive compounds differently optimized in comparison to the first set. This is a time consuming process and, moreover, it also suffers from high defect densities due to the use of two different pads. For Cu planarization, CMP pads are critical, and are as important as the abrasive slurry. Fibrous pads of the prior art have been too soft to obtain good planarization. Stacked nonwoven fiber and other types of pads have previously been tried in an attempt to obtain better CMP performance. However, thin (5 to 20 mils thick) pads of nonwoven fibers bound with polyurethane are not sufficiently durable and do not long survive the CMP process.

Accordingly, the need exists for improved fibrous polishing pads. A high quality CMP pad should meet the following requirements: produce extremely low defects counts on polished surfaces, cause extremely small dishing and extremely low erosion of polished surfaces, and have a long pad life extendible by reconditioning. None of the existing prior art CMP pads can meet all of these requirements, which are needed for the future generation of CMP processes. A new type of CMP pad is therefore needed to meet these requirements.

SUMMARY OF INVENTION

The present invention addresses problems in the prior art and provides a relatively thick, stiff and hard pad comprising nonwoven fibers embedded in a polymer matrix. A nonwoven fiber mat is filled substantially completely with reactants for producing the polymer matrix before those reactants are fully cured. During curing, there may be some shrinkage producing voids in the matrix as the reactants are converted to the final hard polymer. However, the resulting fiber and polymer composite is sufficiently hard to be compatible with current and future CMP process chemistry, and is conditionable after use by grinding (dressing) with a diamond containing abrasive disk or roller to regenerate the working surface of the pad. The pad thickness may also be greater than previously used, which together with pad reconditionability, means that the pad life is significantly longer, such as polishing 500 to 1,000 wafers before pad replacement becomes necessary. Applications are envisioned in the semiconductor and optical industries.

The present invention also relates to a method of making the above disclosed pads. In particular, the method comprises pressing the reactants into the interstices of a fibrous mat in a mold and then, when the interstices are substantially full, curing the reactants to produce the above disclosed polishing pad. Both heat and pressure are applied to cure the precursor system within the fibrous mat in the mold. After curing and removal from the mold, the pad may be buffed with an abrasive disk or roller to remove a skin-like covering and to fracture a surface portion of the polymer to form a thin polishing surface layer of free fibers, segments of which remain embedded in the adjacent composite body.

Still other objects and advantages of the present invention will become readily apparent to those skilled in the art from the following detailed description, wherein is shown and described preferred embodiments of the invention, simply by way of illustration of the best mode contemplated for carrying out the invention. As will be realized by the skilled person, the invention is capable of other and different embodiments, and its details are capable of modifications in various obvious respects, without departing from the invention. Accordingly, the description is to be regarded as illustrative in nature and not as restrictive.

DESCRIPTION OF DRAWINGS

The invention may be further understood by reference to the detailed description below taken in conjunction with the accompanying drawings, in which.

BEST AND VARIOUS MODES FOR CARRYING OUT THE INVENTION

Figure 1:
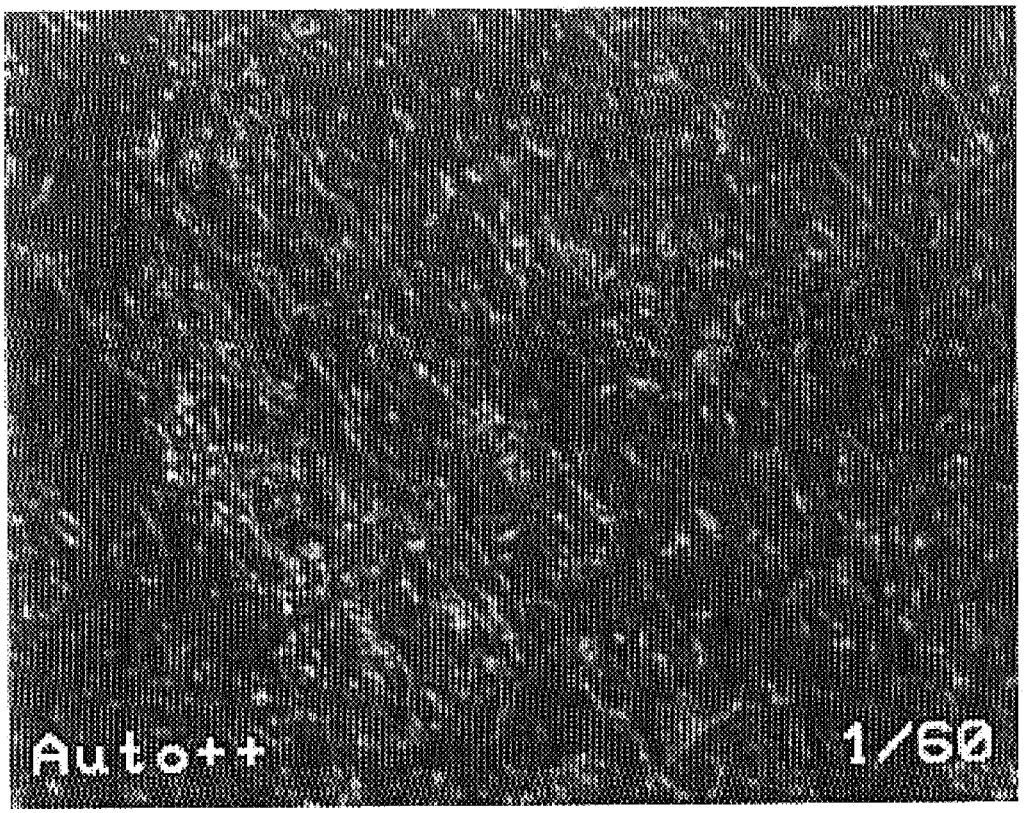
FIG. 1 is a photograph of a portion of the polishing surface of a used pad of the invention taken at a magnification of 100 times.

Typical materials suitable as a first fiber group are Rayon, polycarbonate, polyamide, polyphenylene sulfide, polyimide, Aramide fibers including Nomex and Kevlar, polyvinylchloride, Hemp, and combinations of these fibers. Typical materials suitable as a second fiber group are polyester, polypropylene, Nylon, acrylic, and polyethylene, and combinations of these fibers. The listed fibers are meant to be illustrative of the types that may be used, but the invention is not thereby limited to the enumerated types. The fibers of the first group are preferred because they provide pads having a higher hardness than the fibers of the second group. Combinations of the fibers of the first and second groups are also possible. The fibers and matrix polymers together typically have a hardness of about 30 Shore D to about 100 Shore D, and preferably about 40 Shore D to about 80 Shore D, and more preferably about 50 Shore D to about 70 Shore D, as measured by Durometer Hardness test method ASTM D2240.

The fibers are preferably in the form of a web or mat, but may be individual fibers which are mixed with polymer precursors or to which polymer precursors are added. The fiber web may be a loose pile of fibers or may be formed by any well known nonwoven or woven production techniques, such as needle-punching, hydroentangling, chemical bonding, air-through bonding, weaving, knitting, felting or the like. The fiber mat alone preferably has a Durometer hardness from about 10 to about 90 Shore A, preferably from about 30 to about 70 Shore A, as measured by the aforesaid test method. The web of fibers, before impregnation with the polymer reactants (precursors), preferably has a thickness in the range of about 5 to about 130 mils, more preferably about 15 to about 100 mils, and most preferably about 50 to about 100 mils. During the molding process, these thicknesses may be reduced by about 10 to about 20%. The thickness of a new molded pad is preferably in the range from about 10 mils to about 100 mils. The pad is sufficiently strong and cohesive to be used and reconditioned down to a thickness of about 5 mils.

The fiber mat is embedded in a matrix of a polymeric material. Examples of suitable matrix materials are polyurethanes including polyester and polyether urethanes, polycarbonates, polyacrylates including polymethylmethacrylate (PMMA), polyaramides, thermosetting polymers such as epoxies and derivatives of epoxies, and combinations of these polymers. The chemical-physical properties, hence the polishing performance, of the fiber and polymer composite are governed by the types and sizes of the fibers, the types and hardness of the polymers, the fiber to polymer ratio, the friability of the polymers, and the local and global distribution of the polymer matrix within the fiber mat. For example, employing a larger fiber diameter (thus with fewer fibers for a given density of the fiber mat) and the use of a high fiber:polymer ratio will result in a pad structure having a lower overall density and surface hardness, and a higher compressibility. Conversely, employing a smaller fiber diameter, a lower fiber:polymer ratio, and harder polymer types will result in a pad structure having higher density, lower compressibility and higher surface hardness. A solid polymer is preferred over a porous polymer for the matrix. If the matrix polymer is porous, it is preferable that the pore sizes be in the range of 5–100 microns, more preferably 5–50 microns, to achieve the desired hardness. If the polymer matrix is porous, uniform porosity and a higher density yields pads with better polishing uniformity, less dishing, and a higher polishing rate. This permits greater process throughput and greater product yields.

The pads of the present invention typically comprise about 30 to about 70 percent by weight and preferably about 40 to about 60 percent by weight of the fibers and correspondingly typically about 70 to about 30 percent by weight and preferably about 60 to about 40 percent by weight of the polymeric matrix. The percentages of the fibers and polymeric matrix are based upon the total of the fibers and polymeric matrix in the pad.

Figure 2:
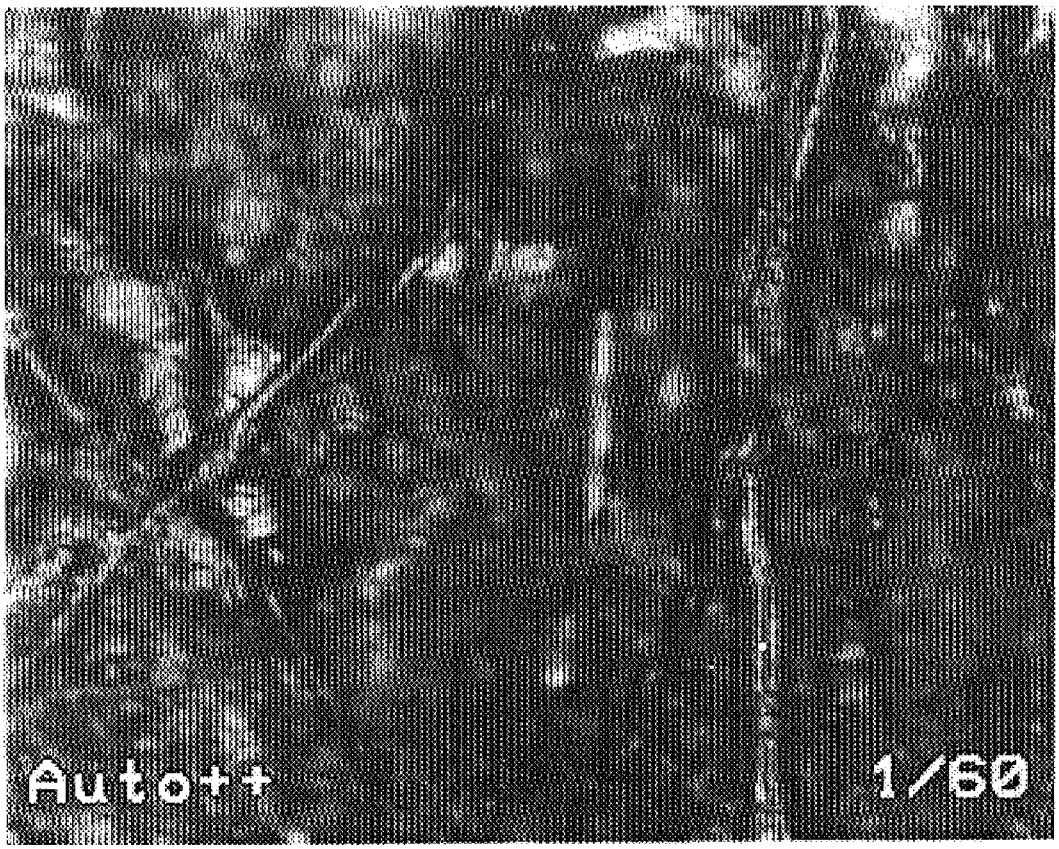
FIG. 2 is a photograph of the polishing surface of the used pad of FIG. 2 taken at a greater magnification of 500 times, and with the image focused on a fiber layer above the surface of the hard polymer and fiber body.
Figure 3:
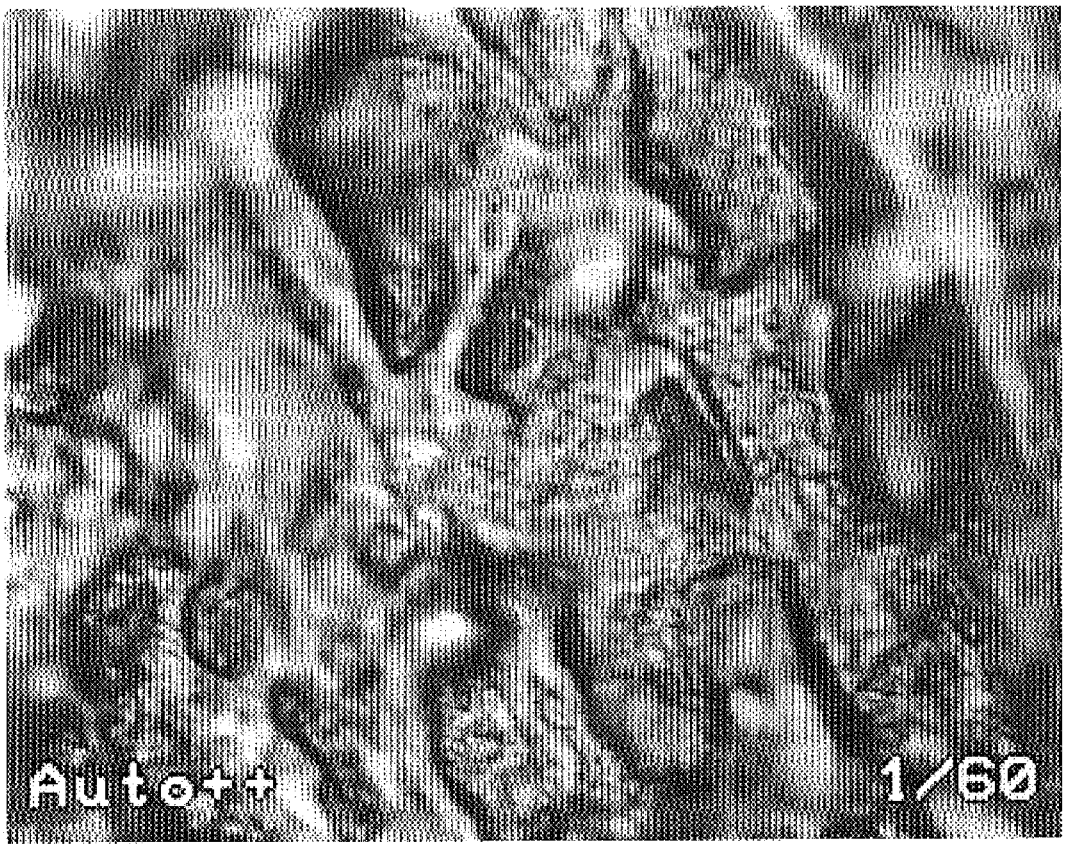
FIG. 3 is a photograph of the polishing surface of the used pad of FIG. 2 taken at a greater magnification of 500 times, and with the image focused on the surface of the hard polymer and fiber body such that the fiber layer above this surface is out of focus.

The pads of the present invention preferably have densities of about 0.5 g/cc to about 1.1 g/cc, and the fiber mats from which the pads are made preferably have densities of about 0.15 g/cc to about 0.9 g/cc. To ensure the desired hardness of the pad, the fiber mat comprises a relatively loose network of fibers and this network is substantially completely filled with the precursor reactants for forming the polymer matrix in which the fiber mat becomes embedded after the reactants are cured. The cured polymer preferably forms a relatively hard but friable matrix. Following curing, the molded pad is conditioned by buffing with a diamond disk or opposing inline abrasive rollers to remove a skin-like polymer surface and expose about a 1 to 2 mil thickness of the fiber mat, which thereby creates about a 1 to 2 mil thick fiber surface layer containing fibers that are partially free. The creation of this surface layer results from the friable nature of the cured polymer matrix. In other words, the strength of the fiber is stronger than the filler or matrix material such that, during buffing, the filler material is removed at the surface while the surface fibers remain attached to the main body or backing layer of the fiber and polymer composite. Thus, after buffing, a small thickness or depth of surface polymer is removed to leave a thin surface layer of free fibers, segments of at least a portion of which remain embedded in the adjacent composite body of polymer and fibers, as can be seen in FIGS. 1, 2, and 3. During CMP processes, this fibrous polishing surface helps to reduce up to or more than about 90% of the defects count caused by using a conventional hard pad. In addition, the solid matrix formed by the polymer densely filling the fiber mat makes the pad up to 50% harder than the hardest conventional CMP pad presently on the market.

Accordingly, the thin fibrous surface layer of the preferred pad of the present invention significantly reduces the defects count of the wafers polished therewith, and the hard backing body or layer beneath the fibrous surface layer results in much less dishing of the polished wafer surface. As a result, metal dishing can be minimized to less than about 0.04% of the size of the metal features on the wafer. In addition, erosion of the wafer surface is very small so as to be negligible.

In addition, the pad surface can be reconditioned after polishing one or more wafers to maintain a high performance level. This makes the pad service life much longer (potentially over 1,000 wafers) than conventional soft fiber-based pads. The conditioning process can actually recreate the thin (about 1 to 2 mils) fibrous surface layer which continues to help reduce the defects count, while the underlying hard fiber and polymer body sufficiently fixes and supports the fiber layer to reduce the dishing phenomenon.

The pads may have multiple layers, as described in U.S. patent application Ser. No. 09/599,514, to allow for independent optimization of pad stiffness and hardness in independent layers. A bottom support layer imparts mechanical stiffness to the pad. The stiffness of the bottom support layer is preferably optimized in relation to the malleability of the material comprising the surface to be worked. The top working layer, the body of which carries and which includes the thin surface layer of free fibers, is preferably optimized with respect both to the properties of the surface to be polished, and with respect to the chemical properties of the abrasive mixture used in the CMP process. Typically, the support layer(s) has stiffer fibers and is thicker than the layer carrying the free fibers used as the polishing surface, and is typically about 55% to about 90% of the total thickness of the pad.

As indicated above, stacked nonwoven and other types of fibrous pads have been tried in the past in an attempt to obtain better CMP performance. However, thin (5 to 15 mil thick) fibrous pads are not sufficiently durable and do not survive the CMP process. In the present invention, a single body polishing pad or the working body of a multi-layer pad can be buffed down to 5 mils while still maintaining structural integrity during the CMP process. In either form, the free fiber layer provides a scratch-free polishing surface and the hard underlying body reduces the excessive dishing which usually occurs during CMP with softer pads. Thus the invention allows for independent control of the optimal properties to prevent over polishing, for compatibility with the substrate to be polished, and for compatibility with the polishing compound.

According to the present invention, the fibers may be precoated with the same or a different polymer prior to being embedded in the matrix polymer. Examples of polymers suitable for precoating the fibers are copolymers of styrene and an acrylate or methacrylate such as ethyl or methyl acrylate or methacrylate; acrylonitrile rubbers; and butadienestyrene rubbers, polyurethanes, fluorocarbons, and epoxy resins.

The precoating may help maintain the stability of the free fibers by enhancing adhesion of segments of these fibers to the polymer matrix and can be used in amounts of about 10 to about 90% by weight and preferably about 15 to 50% by weight based upon the total weight of the fibers and precoating.

The pads of the present invention can be fabricated by forming a loose fibrous web or mat of one or more layers of nonwoven fibers, followed by applying a precoating, when used, to the loose fibrous mat such as by spraying, and then curing the precoat. In the alternative, each of the fiber layers can separately be precoated and then stacked upon each other, followed by partially curing the precoat such as to the B-stage. At this stage, the fibrous mat structure is then embedded into the matrix. This can be accomplished by placing the mat into a pad-shaped mold and applying an unreacted viscous polymer precursor system on top of the mat, such as an isocyanate system known as ADIPRENE from Uniroyal or AIRFLEX from Air Products. The mold is then closed and sufficient differential pressure is applied for causing the polymer precursors to substantially completely fill in the spaces (interstices) between the fibers and thereby embed them in an essentially continuous polymer matrix. As an alternative to pressurizing the mold, a vacuum, such as about minus 10 psig, may be used to pull the polymeric reactants (precursors) into the fibrous mat.

During or after this "fill" stage, the mold is heated to affect either a partial or a final cure of the matrix polymer. The curing of the matrix polymer is typically performed at temperatures of about 60° to about 250° F., preferably about 100° F. to about 180° F.; a pressure of about 1 psig to about 200 psig preferably about 10 psig to about 150 psig, more preferably about 50 psig to about 75 psig; for about 5 to about 24 hours. Where the pad is removed from the mold after only partial curing of the polymer, a final cure may be affected at ambient pressure in an oven or the like, the time and temperature of this cure depending on the polymer and extent of the partial cure.

Whereas composite fiber and polymer pads of the prior art used just enough polymer to bind together the nonwoven fibers of a mat, the present invention substantially completely fills the interstices of the fiber mat with the reactants for the polymer, such as an isocyanate system for polyurethane, to provide an extremely hard polymer matrix with embedded fibers. The pads of the invention also may be made of one or more such hard layers of fiber and polymer composite.

The fibers of the mat used have fiber diameters preferably in the range of about 15 microns to about 70 microns, more preferably about 20 microns to about 50 microns, and most preferably about 25 microns.

Because of the unusually hard matrix of the pad, it may be relatively inflexible. Therefore, after molding has been completed, the pad may be provided with holes to increase its flexibility. Where holes are used to increase pad flexibility, they preferably pass all the way through the pad from the working side to the mounting side, and the size of the holes are preferably in the range of 1/16 inch to 1/4 inch in diameter, with the 1/4 inch holes being preferably spaced 1/2 inch apart and the 1/16 holes being preferably spaced about 1/4 inch apart.

The pads of the present invention are especially amenable to grooving to provide a grooved polishing pad that is capable of consistently forming uniformly polished surfaces on high quality wafers. The apparatus for grooving a pad may comprise a platen with positioning post for holding the pad in position for engagement by a router to machine grooves in the working surface of the pad. In order to precisely control the depth of the grooves as they are routed in the pad, a spacing mechanism may be used to provide a constant and precise separation between the working surface of the pad and the chuck for holding and rotating the router. An apparatus of this type is described in U.S. patent application Ser. No. 09/605,869, filed Jun. 29, 2000, for a "Polishing Pad Grooving Method and Apparatus", the entire contents of this application being incorporated herein by reference. Whereas the fibers of prior art pads are often frayed by such grooving processes, the fibers of the present pads, whether precoated or not, do not sustain significant fraying during the grooving process.

The present pad design therefore offers a versatility of properties and performance required to give a high degree of planarization and global uniformity to a variety of polished substrates. The pads of the present invention can be used for polishing aluminum and aluminum alloys such as Al—Si and Al—Cu, Cu, Cu alloys, W, W alloys, a variety of adhesion and diffusion barriers such as Ti, Ti alloys, TiN, Ta, Ta alloys, TaN, Cr and the like, silicon oxide, polysilicon, silicon nitride, Au, Au alloys, as well as other metals and alloys, and glasses of various compositions.

The polishing slurries employed can be any of the known CMP slurries. Particular examples are alumina in deionized water, or an acidic composition having a pH less than 3 obtained by the addition of hydrofluoric or nitric acid to the alumina and water slurry; and slurries with pH 3 or greater, including basic slurries having a pH above 7.

An embodiment, suitable for the semiconductor industry, is a substantially cylindrical pad having general dimensions such that it might be used in a polishing apparatus, for example in the equipment described in the *IBM Technical Disclosure Bulltin*, Vol. 15, No. 6, November 1972, pages 1760–1761, the entire contents of which are incorporated herein by reference.

As an alternative embodiment, the polishing apparatus includes a polishing station having a rotatable platen on which is mounted a polishing pad, such as illustrated diagrammatically in FIG. 14 of Provisional Application Serial No. 60/214,774, referred to above. The pad in this embodiment is preferably about 10 to about 36 inches, more preferably about 24 inches in diameter, the latter being capable of polishing "eight-inch" or "twelve-inch" semiconductor wafers. The platen typically rotates the pad at speeds from 30 to 200 revolutions per minute, though speeds less than and greater than this range may be used. Semiconductor wafers are typically mounted on a rotatable carrier head using a vacuum chuck. The head presses the wafer against the pad causing polishing, for example with 1 to 10, preferably 2 to 8 pounds per square inch pressure, but greater or lesser pressures could also be used. The rate of polishing is controlled by the composition of the slurry, the rotation rates of the head and platen, and the contact pressure.

Polishing tests on Cu revealed that pads of the present invention provided excellent results that are not obtainable with currently available pads.

The foregoing description of the invention illustrates and describes only the preferred embodiments of the present invention. However, as mentioned above, it is to be understood that the invention is capable of being made and used in various other combinations, modifications, and environments, and is capable of being changed or modified within the scope of the inventive concept as expressed herein, commensurate with the above teachings and/or the skill or knowledge of persons skilled in the relevant art. The embodiments described hereinabove are further intended to explain the best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A polishing pad comprising a body comprising fibers embedded in a matrix polymer formed by a reaction of polymer precursors, the fibers defining interstices, and said precursors filling said interstices substantially completely before completion of said reaction, wherein said polishing pad further comprises a polishing layer of free fibers, at least a portion of which have a segment thereof embedded in the matrix polymer of said body.

2. A polishing pad according to claim 1, wherein said polishing layer of free fibers has a thickness of about 2 mils or less.

3. Polishing pad according to claim 1, wherein said fibers comprise a fiber web formed by a nonwoven technique, including needle-punching, hydroentangling, chemical bonding, or air-through bonding, or by a woven technique, including weaving, knitting, or felting.

4. A polishing pad according to claim 3, wherein said fiber web has a Durometer hardness in the range of about 10 to about 90 Shore A.

5. A polishing pad according to claim 3, wherein said fiber web has a density in the range of about 0.15 to about 0.9 g/cc.

6. A polishing pad according to claim 1, wherein the fibers are made of a polyester, polypropylene, polyamide, rayon, polyimide, or polyphenylene, or a combination of said fibers.

7. A polishing pad according to claim 1, wherein said polymer is a solid or a porous polyurethane, polycarbonate, polymethylmethacrylate (PMMA) or epoxy.

8. A polishing pad according to claim 1, wherein after said reaction said pad has a Durometer hardness in the range of about 50 to about 100 Shore D.

9. A polishing pad according to claim 1, wherein said polymer is a solid polyurethane.

10. A polishing pad according to claim 1, wherein, after said reaction, said pad comprises about 20% to about 80% fibers by weight and about 80% to about 20% polymer by weight.

11. A polishing pad according to claim 1, wherein, after said reaction, said pad has a density in the range of about 0.5 to about 1.1 g/cc.

12. A polishing pad according to claim 1, wherein, after said reaction, said pad has a thickness in the range of about 10 to about 130 mils.

13. A polishing pad comprising a body comprising fibers embedded in a matrix polymer formed by a reaction of polymer precursors, the fibers defining interstices, and said precursors filling said interstices substantially completely before completion of said reaction, wherein said polishing pad further comprises a polishing layer of free fibers, at least a portion of which have a segment thereof embedded in the matrix polymer of said body, and wherein said reaction results from applying both pressure and heat to said polishing pad.

14. A polishing pad according to claim 13, wherein said polishing layer of free fibers has a thickness of about 2 mils or less.

15. A polishing pad according to claim 13, wherein said fibers comprise a fiber web formed by a nonwoven technique, including needle-punching, hydroentangling, chemical bonding, or air-through bonding, or by a woven technique, including weaving, knitting, or felting.

16. A polishing pad according to claim 15, wherein said fiber web has a Durometer hardness in the range of about 10 to about 90 Shore A.

17. A polishing pad according to claim 15, wherein said fiber web has a density in the range of about 0.15 to about 0.9 g/cc.

18. A polishing pad according to claim 13, wherein the fibers are made of a polyester, polypropylene, polyamide, rayon, polyimide, or polyphenylene, or a combination of said fibers.

19. A polishing pad according to claim 13, wherein said polymer is a solid or a porous polyurethane, polycarbonate, polymethylmethacrylate (PMMA) or epoxy.

20. A polishing pad according to claim 13, wherein after said reaction said pad has a Durometer hardness in the range of about 50 to about 100 Shore D.

21. A polishing pad according to claim 13, wherein said polymer is a solid polyurethane.

22. A polishing pad according to claim 13, wherein after said reaction, said pad comprises about 20% to about 80% fibers by weight and about 80% to about 20% polymer by weight.

23. A polishing pad according to claim 13, wherein, after said reaction, said pad has a density in the range of about 0.5 to about 1.1 g/cc.

24. A polishing pad according to claim 13, wherein, after said reaction, said pad has a thickness in the range of about 10 to about 130 mils.

* * * * *

UNITED STATES PATENT AND TRADEMARK OFFICE

CERTIFICATE OF CORRECTION

PATENT NO. : 6,712,681 B1
DATED : March 30, 2004
INVENTOR(S) : Shyng-Tsong Chen et al.

It is certified that error appears in the above-identified patent and that said Letters Patent is hereby corrected as shown below:

Title page,
Item [73], Assignees, should read

-- [73] Assignees: International Business Machines Corporation, Armonk, NY (USA); and Freudenberg Nonwovens, Ltd. Partnership, Lowell, MA (USA) --

Signed and Sealed this

First Day of June, 2004

JON W. DUDAS
*Acting Director of the United States Patent and Trademark Office*